United States Patent [19]

Solomon

[11] 4,054,209

[45] Oct. 18, 1977

[54] GARMENT RACK

[75] Inventor: Archie Solomon, Roswell, Ga.

[73] Assignees: Harold Solomon Trust; Lisa Solomon Trust; Susan Solomon Trust; Wendy Solomon Trust; Mark Solomon Trust; Jonathan Solomon Trust, all of Atlanta, Ga.

[21] Appl. No.: 674,486

[22] Filed: Apr. 7, 1976

[51] Int. Cl.[2] ..... A47B 57/00

[52] U.S. Cl. ..... 211/208; 248/320

[58] Field of Search ..... 211/195, 204, 206, 175, 211/207, 208, 124, 7, 8, 182; 182/209, 210; 248/320, 322, 340, 295, 101, 83, 500, 504, 507, 509, 510; 5/100

[56] References Cited

U.S. PATENT DOCUMENTS

| | | | |
|---|---|---|---|
| 850,658 | 4/1907 | Koonce | 211/207 |
| 1,144,957 | 6/1915 | Andree | 211/182 |
| 1,151,774 | 8/1915 | Foster | 5/100 X |
| 3,303,938 | 2/1967 | Solomon | 211/182 |
| 3,503,525 | 3/1970 | Loebner | 211/206 |
| 3,805,054 | 4/1974 | Wolf | 248/320 X |

*Primary Examiner*—Roy D. Frazier
*Assistant Examiner*—Terrell P. Lewis
*Attorney, Agent, or Firm*—Newton, Hopkins, Ormsby

[57] ABSTRACT

An improved garment rack comprising a movable base and first and second hanger rods supported on a pair of stanchions which extend upwardly from the base, the second rod being adjustably disposed beneath the first rod between an upper position juxtaposed of the first rod to allow long garments to hang from the second rod and a position lower than the upper position so that relatively short garments can be hung from the first and second rods. Means are provided for releasably holding the second rod in the upper and lower positions.

3 Claims, 8 Drawing Figures

GARMENT RACK

BACKGROUND OF THE INVENTION a. Field of the Invention

This invention relates generally to horizontal rod-type supports and in particular to movable garment racks.

b. Description of the Prior Art

The present invention is an improvement of my U.S. Pat. No. 3,303,938, issued Feb. 14, 1967 and my U.S. Pat. No. 3,921,814, issued Nov. 25, 1975. Racks of that type are suitable for transporting garments of generally uniform length. However, since those racks have only a single hanger rod which is normally positioned at a height suitable for dresses or other long garments, the racks are inefficiently used when transporting suit jackets or other shorter garments. The same rack could carry twice as many suit jackets and the like if a second hanger rod were located intermediate the single hanger rod and the base. However, a rack with two stationary hanger rods could not effectively be used to transport long dresses and the like.

SUMMARY OF THE INVENTION

An improved garment rack is provided for movably supporting either a single row of relatively long garments or a double row of relatively short garments having a base, two stanchions extending upwardly from the base, a first hanger rod horizontally supported on the stanchions, and a second hanger rod slidably movable on the stanchions between an upper position adjacent the first support rod and selected lower positions. Holding means are provided for releasably securing the second hanger rod at the upper position, the holding means comprising an element pivotably mounted at one of its ends about the first hanger rod and having an upwardly sloping camming surface along its bottom end. A slot is formed in the side of the element which is adjacent the termination of the upward slope of the camming surface, the top and bottom edges of the slot being generally parallel to the slope of the camming surface. The slot is of sufficient dimensions to receive the second hanger rod therein.

In its operation, the second hanger rod is placed at a selected lower position if it is desired to hang a double row of short garments, such as coats, on the garment rack. In that manner, the coats can be hung from both the first and second rods.

When it is desired to hang a single row of long garments on the rack, the second rod is raised toward the first rod. As the second rod strikes the camming surface of the holding means, the holding means pivots to allow additional upward movement of the second rod until the rod engages the upper opening edge of the slot, at which time the rod is lowered slightly to allow the rod to be captured within the slot.

To release the second rod from the holding means, the rod is raised upwardly against the top edge of the slot which causes the holding means to pivot to disengage the rod so that the rod can be lowered to any desired lower position.

In one embodiment, the axis of rotation of the holding means is coincident with the longitudinal axis of rotation of the first rod; in the other embodiment, the axis of rotation of the holding means is normal to the longitudinal axis of the first rod.

Accordingly, it is an object of the present invention to provide an improved portable garment rack which is suitable for carrying one row of long garments or two rows of short garments.

Another object of the invention is to provide an improved portable garment rack wherein a second hanger rod is automatically releasably secured at selected positions beneath a top stationary hanger rod.

DESCRIPTION OF THE ILLUSTRATED EMBODIMENTS

FIRST EMBODIMENT

Figure 1:
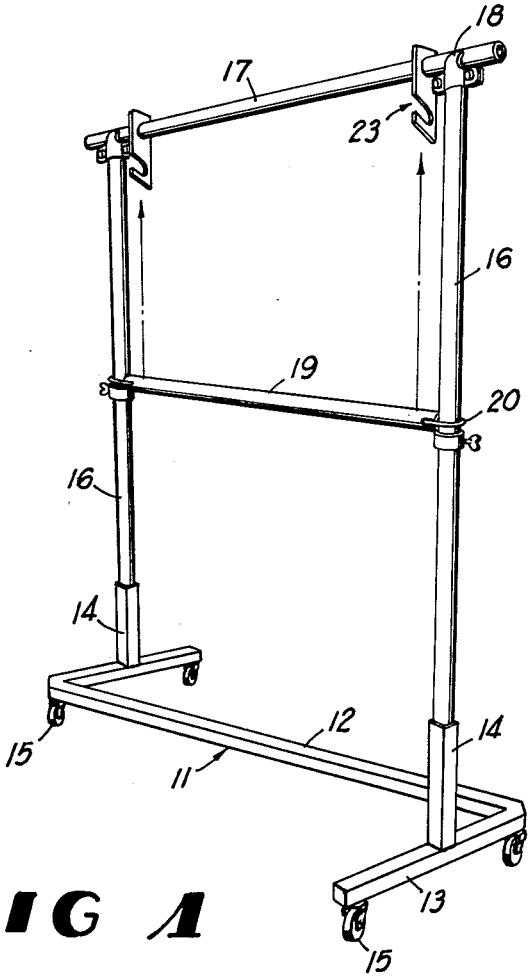
FIG. 1 is a perspective view of the improved garment rack according to the first embodiment of the present invention.

Referring now to the embodiment of the improved garment rack shown in FIGS. 1–4, there is shown in FIG. 1 a portable garment rack 10 having a Z-shaped base portion 11. The base 11 includes a transverse member 12, a pair of substantially parallel members 13 extending in opposite directions from the opposite ends of the transverse member 12, a pair of sleeves 14 extending upwardly from about the mid-points of members 13 and four casters 15 mounted below the ends of the substantially parallel members 13. The casters 15 movably support the Z-shaped base 11 along the ground. A pair of upstanding tubular stanchions 16 are mounted in the upstanding sleeves 14. A tubular first hanging rod 17 is horizontally secured at the top of each stanchion 16 by mounting elements 18.

Figure 4:
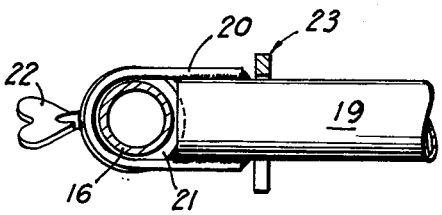
FIG. 4 is a cross-sectional top plan view taken along line 4—4 of FIG. 2.

A second tubular hanging rod 19 is slidably disposed between stanchions 16 at preselected positions below the first rod 17 by any suitable adjustable holding means. As shown in FIGS. 1 and 4, the illustrated adjustable holding means include thin, tubular U-shaped extensions or guide elements 20 which are secured at both of their ends or each end of rod 19 and which encompass therebetween stanchions 16. Elements 20 guide the rod 18 along stanchions 16. A pair of rings 21 are slidably mounted on the stanchions 16 and are provided with set screws 22 which secure rings 21 at any desired height along stanchions 16. The securing of the rings 21 at a desired height along stanchions 16 provides the lowest position of rod 19 on the rack 10, because the bottom ends of the rod 19 rest on the tops of the rings 21 as shown in FIG. 4 and thereby preventing any further downward movement of the rod 19.

Holding means is mounted on the rack 10 for securing the rod 19 in an upper position below the first rod 17. The holding means of the first embodiment of the invention is a flat plate or latch element 23 being generally trapezoidal in shape and having its two longer sides parallel and its shorter ends not parallel to each other. The plate 23 is pivotally mounted on rod 17 which passes through hole 24 located in the middle of the plate 23 adjacent end 25 so that the axis of rotation of plate 23 is coincident with the longitudinal axis of rod 17. Side 26 is longer than side 27 and terminates in an upwardly sloping lower camming surface 28. A slot 29 is formed in side 27 adjacent the termination of the upward slope of surface 28. The dimensions of slot 29 are sufficient to receive therein the rod 19, as explained in detail hereinbelow. The bottom edge 30 and top edge 31 of the slot 29 are parallel to camming surface 28 and are connected by curved portion 32. Although top edge 31 is shown as being parallel to surface 28, the edge 31 need only present some camming surface to the top of rod 19. When the plate 23 is in its rest position as shown in FIG. 1, the camming surface 28 is in the path of upward travel of rod 19.

As seen in FIG. 1, the rack 10 is provided with a pair of plates 23 mounted on rod 17 between stanchions 16 adjacent mounting elements 18. Although not illustrated, a single plate 23 could be utilized by being centrally located on rod 17.

OPERATION OF FIRST EMBODIMENT

Figure 2:
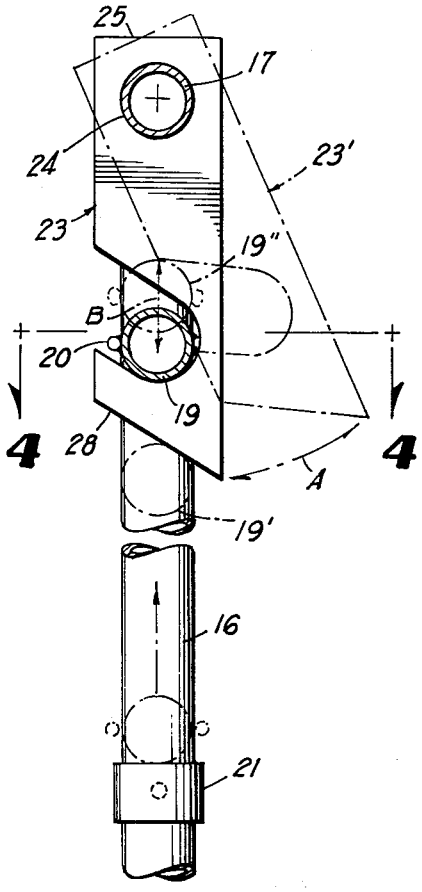
FIG. 2 is a fragmented side elevational cross-sectional view of the garment rack in an operational mode.

By means of set screws 22, the rings 21 can be set at any height along stanchions 16. Once set, the bottom of rod 19 is allowed to rest on the top of rings 21, as shown in FIGS. 1 and 2. In that manner, short garments on hangers can be hung from both rods 17 and 19, as illustrated by broken lines in FIG. 5.

When it is desired to hang only one row of long garments upon rack 10, the rod 19 is moved upwardly manually toward rod 17 along stanchions 16 guided by guide elements 20 until it engages surface 28, the rod 19 then assuming the position as indicated in broken lines as numeral 19' 2. FIG. 12. Further upward movement of rod 19' causes surface 28 to ride along the top of rod 19' and allows plate 23 to pivot about hole 24 along the path of travel as indicated as arrow A to the position as shown in broken lines in FIG. 2 as 23'. The rod 19' continues upwardly until it contacts the juncture of side 27 with upper edge 31, the position of the rod 19' at that point being represented in broken lines as 19''. The rod 19'' is clear of engagement with surface 28 and is then lowered a short distance as represented by arrow B to allow the plate 23' to pivot as indicated by arrow A to its original or rest position by having edge 31 ride along the top of rod 19 so rod 19 is held on bottom edge 30 within slot 29. The rod 19 is now in its upper position beneath rod 17 long garments can be hung from rod 19, shown in broken lines in FIG. 5 as 190'.

Figure 3:
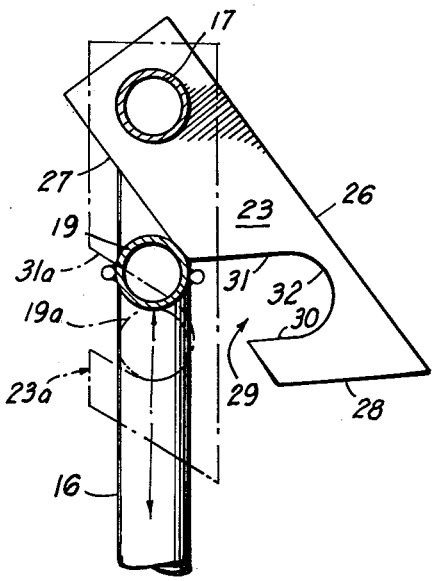
FIG. 3 is a fragmented side elevational cross-sectional view of the invention in another operational mode.

To return rod 19 to its position as shown in FIG. 1, reference in made to FIG. 3 wherein the rod 19 is shown in broken lines in its latched or secured positions as **19*a* and the plate as 23*a*. The rod 19*a* is moved upwardly until it engages edge 31*a* which acts as a camming surface to cause plate 23*a* to pivot to its position as shown in solid lines in FIG. 3. The rod 19*a* is raised until it engages the portion of side 27 above edge 31, as shown in solid lines in FIG. 3 and then is quickly pulled downwardly so that plate 23 will pivot to its position 23*a* or rest position. The rod 19 is lowered to a position as shown in FIG. 1 which is far beneath upper hanger rod 17, relative to its position at 19*a*.**

SECOND EMBODIMENT

The second embodiment of the present invention is illustrated in FIGS. 5–8 and is referred to generally by numeral 100 having a base 110 corresponding to base 11 of the first embodiment. The stanchions 160 support a top hanger rod 170 by means of flat, U-shaped guide elements 200 secured at both ends of rod 190 around stanchion 160. Rings 210 are placed at selected heights along stanchions 160 by means of set screws 220 to provide the low position of the rod 190 on rack 100. The bottom of the guide elements 200 as well as the bottom of rod 190 adjacent its ends rest on the top of rings 210 when the rod 190 is in its lowest position.

Figure 6:
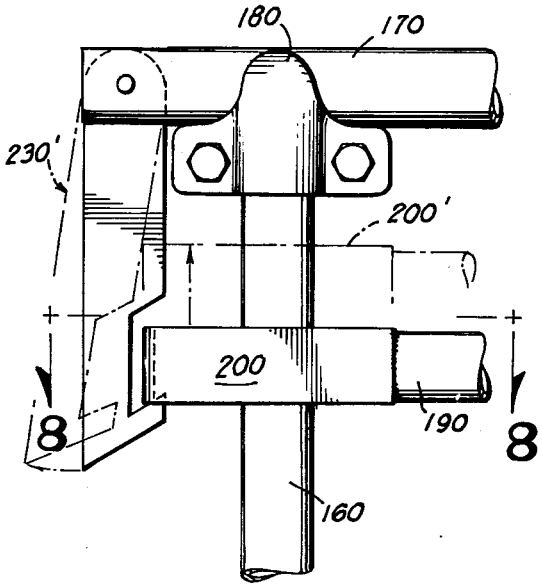
FIG. 6 is a fragmented front elevational view of the improved garment rack in an operational mode.
Figure 7:
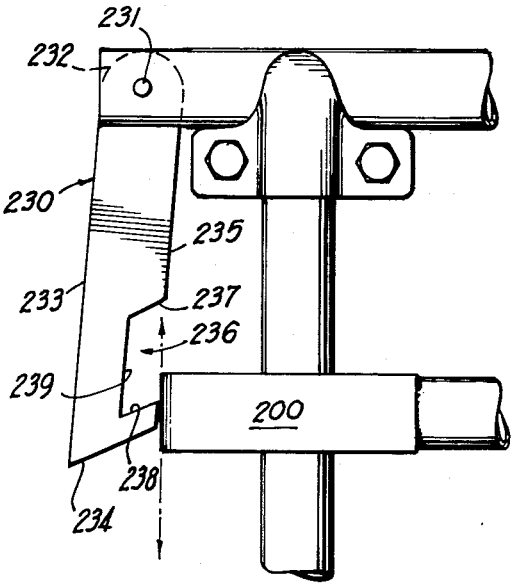
FIG. 7 is a fragmented front elevational view of the invention in another operational mode.
Figure 8:
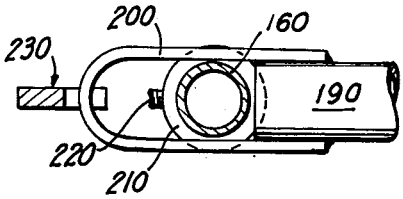
FIG. 8 is a cross-sectional top plan view taken along line 8—8 of FIG. 6.

The rod 190 is releasably held in its upper position beneath rod 170 by means of holding means or latch 230 which is pivotally mounted on rod 170 by means of a pin 231 radially disposed through rod 170 near its end and through latch 230 adjacent its rounded top end 232. A slit (not shown) is longitudinally formed through each end of rod 170 beneath pin 231 and is of sufficient dimensions to receive latch 230 therein. The length of the slit is such as to allow latch 230 to hang vertically when not in its operative mode, but prevents the latch 230 from swinging to the right as illustrated in FIGS. 6 and 7 as described in detail hereinbelow. The top end 232 snugly engages the inside of rod 170, as shown in FIGS. 6 and 7.

The latch 230 is mounted adjacent the end of rod 170 which is exterior of mounting element 180. The latch has a long side 233 which faces away from stanchion 160 and which terminates in an upwardly sloping bottom surface 234. The other side 235 of latch 230 is parallel to side 233 and has a slot or notched portion 236 adjacent surface 234. The top 237 and bottom 238 edges of notched portion 236 are parallel to surface 234; side wall 239 is parallel to sides 233 and 235. The dimensions of notched portion 236 are sufficient to receive therein element 200.

The rack 100 functions in the same manner as rack 10 with the only difference being the means for releasably securing rod 190 in its upper position. When it is desired to move the rod 190 from its position shown in solid lines in FIG. 5 to the position in broken lines and referred to as 190' the rod 190 is manually raised upwardly until the top edge of element 200 engages the surface 234. Further upward movement of rod 190 causes the latch 230 to begin to pivot about pin 231 away from stanchions 160. Continued upward advancement of rod 190 has latch 230 assume the position as shown in FIG. 7. The rod 190 is pushed upwardly until the bottom edge of element 200 clears edge 238 of notched portion 236; at that point, the latch 230 has pivoted to the position as shown in dotted lines in FIG. 6 and referred to by numeral 230' and element 200 is in the position referred to as 200'. The rod 190 is then lowered slightly until the element 200 is within the opening of notched portion 236, allowing the latch 230' to swing back to its rest position and thereby having edge 238 engage the bottom edge of element 200 as shown in FIG. 6. The rod is then in its secured, upper position 190'.

To release the rod 190 from latch 230, the rod 190 is manually pushed upwardly so that element 200 engages top edge 237 which acts as a camming surface to cause the latch 230 to pivot to its position illustrated as 230'. With element 200 in the position shown as 200' the rod 190 is quickly lowered to allow element 200 to pass by latch 230' before it swings to its rest position 230. The rod 190 is lowered until elements 200 engage the top of rings 210, whereby rod 190 assumes the position as shown in FIG. 5.

Figure 5:
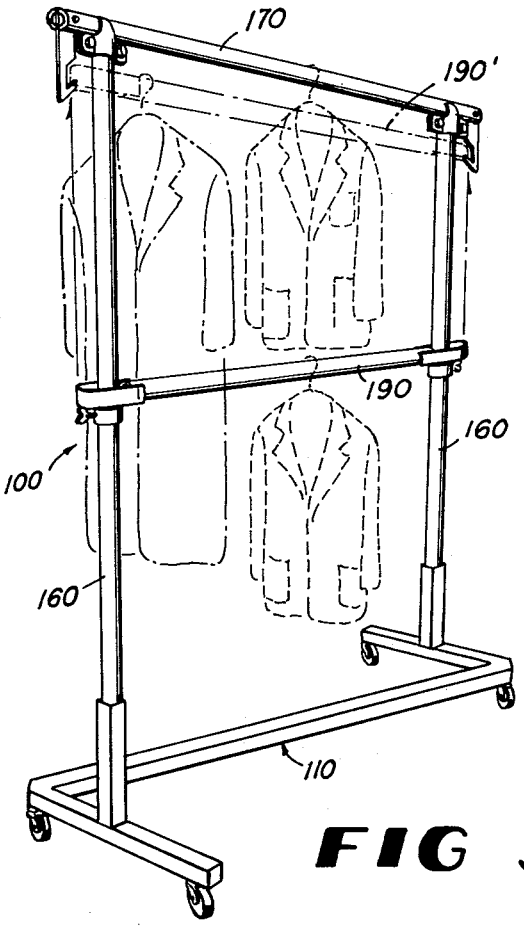
FIG. 5 is a perspective view of the improved garment rack according to the second embodiment of the present invention.

The illustration of the garments as the hangers in FIG. 5 will serve to demonstrate the utility of the present invention as an improved garment rack which is suitable for carrying one row of long garments when the lower rod 190 is secured in its upper position 190' or two rows of short garments when the rod 190 is in its lower position. When the rod 190 is in its latched position 190', the close proximity of upper rod 170 allows for the hangers to be easily placed onto rod 190' as the rod 170 acts as a camming surface to guide the hook portion of the hangers downwardly onto rod 190'. Although the utility of the present invention is described with reference to the second embodiment, the utility of the first embodiment is the same.

It is understood, of course, that the means for releasably securing the lower rod in its lower position may take any convenient form other than the ring and set screw arrangement as shown.

What I claim is:

1. In a portable garment rack having a base, a pair of upright stanchions mounted to the base, and an upper hanger rod mounted to an upper portion of said pair of stanchions, the improvement comprising a height adjustable hanger rod slidably mounted to said pair of stanchions for movement therealong, first means on said upper hanger rod for releasably holding said height-adjustable hanger rod in an upper position close beneath said upper hanger rod, and second means for releasably holding said height-adjustable hanger rod in a lower position far beneath said upper hanger rod, whereby the height-adjustable hanger rod may be placed in its upper position for the rack to support a single row of long garments and placed in its lower position for the rack to support a double row of garments which are shorter in length than said long garments and wherein said first releasable holding means includes an element having a top end about which said element is pivotally mounted on said rack, opposed sides, an upwardly sloping camming surface on its lower end, said surface being in the path of travel of said height-adjustable hanger rod as it is moved to its upper position when said element is in its rest position and a slot formed in one of said sides which is adjacent the termination of the upward slope of said surface, said slot being of sufficient dimensions to receive a portion of said height-adjustable rod therein, said element being pivoted away from said rod position when said height-adjustable hanger rod engages said surface as said height-adjustable hanger rod is raised to said upper position and pivoting to its rest position as said rod clears said camming surface so that said hieght-adjustable hanger rod is automatically received within said slot, thereby holding said height-adjustable rod in its upper position, the upper edge of said slot having a camming surface so that when said height-adjustable hanger rod is within said slot and is raised upwardly, said upper edge camming surface is engaged to cause said element to pivot away from its rest position to disengage said height-adjustable hanger rod, thereby allowing said height-adjustable hanger rod to be lowered to said lower position, said height-adjustable hanger rod including an extension connected about each of its ends around said stanchions to guide said height-adjustable hanger rod in its movement along said stanchions, said upper hanger rod extending beyond said pair of stanchions, a pin extending radially through said upper hanger rod adjacent each of its ends, said upper hanger rod having a slot formed through each of its ends and extending beneath said pins, and said element being mounted at its top pivotally about each of said pins and extending through said slots, whereby the axis of rotation of each of said elements is normal to the longitudinal axis of said upper hanger rod.

2. An improved garment rack as claimed in claim 1 wherein said camming surface on each of said elements is in the path of the upward movement of said extensions.

3. In a portable garment rack having a base, a pair of upright stanchions mounted on said base in spaced parallel relation, an upper horizontal hanger rod secured to the tops of said stanchions and having opposite end portions projecting outwardly beyond the outer sides of the stanchions, said opposite end portions of the upper hanger rod being vertically slotted, horizontal axis transverse pivot pins on said outer end portions and intersecting the slots of the outer end portions at right angles to the planes of the slots, depending gravity biased latch elements having their upper ends pivotally engaged with said pins within said vertical slots and lying outwardly of said stanchions and being in opposed relation, a height-adjustable hanger rod on said stanchions and shiftable toward and away from the upper hanger rod, means on said stanchions to limit the downward movement of said height-adjustable hanger rod, substantially U-shaped guidance and latching elements carried by the opposite ends of the height-adjustable hanger rod and embracing said stanchions slidably and having outer end bight portions disposed outwardly of the outer sides of said stanchions and in substantial alignment with said gravity biased latch elements when the latter are free-hanging, whereby upward shifting of said height-adjustable hanger rod will cause said bight portions to enter into latched engagement with the gravity biased latch elements with the height-adjustable hanger rod positioned near and below said upper hanger rod.

* * * * *